US008252492B2

(12) United States Patent
Kuramashi

(10) Patent No.: US 8,252,492 B2
(45) **Date of Patent: *Aug. 28, 2012**

(54) TONER FOR ELECTROSTATIC DEVELOPMENT, IMAGE FORMING APPARATUS, AND IMAGE FORMING METHOD

(75) Inventor: Koji Kuramashi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 654 days.

This patent is subject to a terminal disclaimer.

(21) Appl. No.: 12/470,263

(22) Filed: May 21, 2009

(65) Prior Publication Data

US 2010/0062356 A1 Mar. 11, 2010

(30) Foreign Application Priority Data

Sep. 10, 2008 (JP) ..... 2008-232245

(51) Int. Cl.
*G03G 9/08* (2006.01)

(52) U.S. Cl. ..... 430/108.1; 430/108.7

(58) Field of Classification Search ..... 430/108.1, 430/108.7

See application file for complete search history.

(56) References Cited

U.S. PATENT DOCUMENTS

| | | | | |
|---|---|---|---|---|
| 2006/0003247 | A1* | 1/2006 | Baker et al. | 430/109.3 |
| 2006/0172216 | A1* | 8/2006 | Goto | 430/109.3 |
| 2006/0204883 | A1 | 9/2006 | Nakayama et al. | |
| 2010/0062354 | A1* | 3/2010 | Kuramashi | 430/107.1 |

FOREIGN PATENT DOCUMENTS

| | | |
|---|---|---|
| CN | 1853143 | 10/2006 |
| JP | 63-075754 | 4/1988 |
| JP | 04-274249 | 9/1992 |
| JP | 8-12465 | 2/1996 |
| JP | 2005-157342 | 6/2005 |

* cited by examiner

*Primary Examiner* — Hoa V Le
(74) *Attorney, Agent, or Firm* — Frommer Lawrence & Haug LLP

(57) ABSTRACT

An embodiment of toner for electrostatic development may include toner base particles, and resin fine particles. Further, some embodiments may include external additives, such as hydrophobic silica. In some embodiments, the resin fine particles may include a polymer having an isobornyl group-containing acrylate monomer.

18 Claims, 1 Drawing Sheet

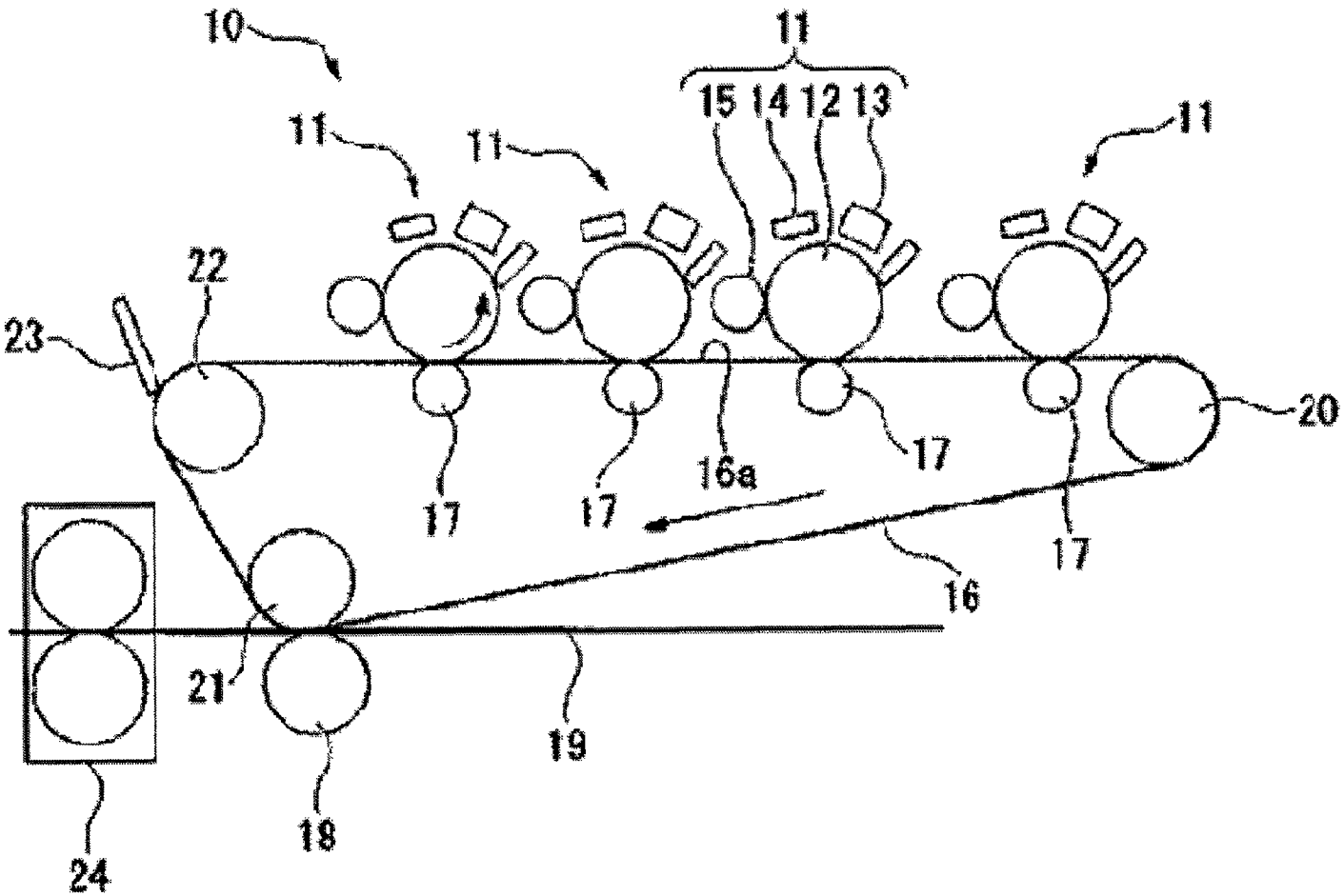
10
11
11
11
11
13
12
14
15
16
16a
17
17
17
17
18
19
20
21
22
23
24

TONER FOR ELECTROSTATIC DEVELOPMENT, IMAGE FORMING APPARATUS, AND IMAGE FORMING METHOD

INCORPORATION BY REFERENCE

This application is based upon and claims the benefit of priority from the corresponding Japanese Patent application No. 2008-232245, filed Sep. 10, 2008, the entire content of which is incorporated herein by reference.

FIELD OF THE INVENTION

The present invention relates to a toner for electrostatic development, an image forming apparatus, and an image forming method.

BACKGROUND OF THE INVENTION

In recent years, there have been demands for higher image quality, longer operating life, and higher speed in image forming apparatuses, such as printers and multi-functional image forming apparatuses. In conjunction with these demands, it has been desired to decrease the particle size of toner for electrostatic development (hereinafter, may be simply referred to as "toner"). However, as the diameter of toner particles decreases, it tends to become difficult to control the charge amount of toner particles. Therefore, there are limits to the extent to which the operating life and speed can be increased.

Under these circumstances, methods are known for controlling the charge amount of toner by changing the type and the amount of charge control agent added which may be constituent of toner base particles or an external additive to be externally added to the toner base particles. As the external additive, hydrophobic silica, titanium oxide, and the like are often used. Recently, resin fine particles have been receiving attention as an external additive.

For example, for the purpose of stabilizing the charge amount of toner even in the case where copying is repeatedly performed for a long period of time or in a special environment, such as a high temperature, high humidity environment or a low temperature, low humidity environment, a developer has been proposed in which positively charged silica fine powder and negatively charged fluorine-containing resin fine particles are used as the external additives to be externally added to toner base particles. Furthermore, in order to prevent the toner from fusing on a photosensitive member and a charging roller which are components of an image forming apparatus and to maintain the charge amount of the developer, a developer has been proposed in which styrene acrylic resin fine particles having two different particle sizes and inorganic fine particles are added to the toner base particles. As in the proposed developers, by using resin fine particles as external additives, the charge amount of the toner can be maintained even after the developer has been used for a long period of time.

However, in resin fine particles which are generally used as external additives, such as fluorine-containing resin fine particles and styrene acrylic resin fine particles which are used in the proposed developers, the charge amount easily increases excessively and the mechanical strength is low. Therefore, the resin fine particles are relatively easily melted, and thus, easily adhere onto the photosensitive member. The toner and the external additives which have adhered onto the photosensitive member are usually removed by a cleaning member or the like for cleaning the surface of the photosensitive member. However, since the resin fine particles have a smaller particle diameter than toner base particles and other external additives (e.g., hydrophobic silica and titanium oxide), the resin fine particles easily slip through the cleaning member and are difficult to remove.

In particular, when printing is continuously performed in a high temperature, high humidity environment, with resin fine particles which have adhered onto the photosensitive member, resin fine particles may further adhere onto the photosensitive member in the shape of a dashed line, such as that formed by scratching with a pen. The portion of the surface of the photosensitive member to which the resin fine particles have adhered is not easily charged. When image formation is performed, since the portion of the surface of the photosensitive member to which the resin fine particles have adhered has a low charge potential, the toner adheres from a developing device to the portion. When the toner is transferred to paper, an undesired black spot or black line appears on the paper image formed. Consequently, when resin fine particles adhere to the surface of the photosensitive member, image defects easily occur.

SUMMARY OF THE INVENTION

It is an object of the present invention to provide a toner for electrostatic development in which chargeability may be satisfactorily maintained. In some embodiments, a toner may be provided which reduces adhesion of resin fine particles to a photosensitive member in a high temperature, high humidity environment. These toners may be utilized in an image forming apparatus and an image forming method described herein.

A toner for electrostatic development may include, but is not limited to toner base particles and additives. In an embodiment, a toner may include, but is not limited to toner base particles and additives, such as resin fine particles and hydrophobic silica. In some embodiments, the resin fine particles may include a polymer having an isobornyl group-containing acrylate monomer.

The above and other objects, and features of the invention will be more apparent from the following detailed description of embodiments taken in conjunction with the accompanying drawings.

In this text, the terms "comprising", "comprise", "comprises" and other forms of "comprise" can have the meaning ascribed to these terms in U.S. Patent Law and can mean "including", "include", "includes" and other forms of "include".

The various features of novelty which characterize the invention are pointed out in particularity in the claims annexed to and forming a part of this disclosure. For a better understanding of the invention, its operating advantages and specific objects attained by its uses, reference is made to the accompanying descriptive matter in which embodiments of the invention are illustrated in the accompanying drawings showing components identified by the same reference numerals.

BRIEF DESCRIPTION OF THE DRAWING

The following detailed description, given by way of example, but not intended to limit the invention solely to the specific embodiments described, may best be understood in conjunction with the accompanying drawing, in which:

FIG. 1 is a schematic diagram showing an image forming apparatus according to the present invention.

DETAILED DESCRIPTION OF THE EMBODIMENTS

Reference will now be made in detail to various embodiments of the invention, one or more examples of which are illustrated in the accompanying drawings. Each example is provided by way of explanation of the invention, and by no way limiting the present invention. In fact, it will be apparent to those skilled in the art that various modifications, combinations, additions, deletions and variations can be made in the present invention without departing from the scope or spirit of the present invention. For instance, features illustrated or described as part of one embodiment can be used in another embodiment to yield a still further embodiment. It is intended that the present invention covers such modifications, combinations, additions, deletions, applications and variations that come within the scope of the appended claims and their equivalents.

A toner for electrostatic development (hereinafter referred to as "toner") may include, but is not limited to toner base particles and external additives. The external additives may be added to the toner base particles such that the external additives adhere to at least a portion of the surface of the toner base particles. In some embodiments, a portion of the added external additives may be contained in the toner without adhering to the toner base particles.

The toner base particles may include, but are not limited to a binder resin and a colorant. For example, some embodiments may include multiple binder resins and/or colorants.

Binder resins for use in the toner may include, but are not limited to thermoplastic resins, such as polystyrene resins, polyester resins, acrylic resins, styrene acrylic copolymers, polyethylene resins, polypropylene resins, vinyl chloride resins, polyamide resins, polyurethane resins, polyvinyl alcohol resins, vinyl ether resins, N-vinyl resins, and styrene-butadiene resins, any resins known or yet to be discovered in the art or combinations thereof. In some embodiments, a polyester resin may be used as the binder resin. For example, a polyester resin may be obtained by condensation polymerization or condensation copolymerization of an alcohol component and a carboxylic component.

Colorants for use in the toner may include, but are not limited to black pigments, such as carbon black (e.g., acetylene black, lamp black, and aniline black); yellow pigments, such as chrome yellow, zinc yellow, cadmium yellow, yellow iron oxide, mineral fast yellow, nickel titanium yellow, Naples yellow, naphthol yellow S, Hansa yellow G, Hansa yellow 10G, benzidine yellow G, benzidine yellow GR, quinoline yellow lake, permanent yellow NCG, and tartrazine lake; orange pigments, such as red chrome yellow, molybdenum orange, permanent orange GTR, pyrazolone orange, Balkan orange, indanthrene brilliant orange RK, benzidine orange G, and indanthrene brilliant orange GK; red pigments, such as colcothar, cadmium red, red lead, mercury sulfide cadmium, permanent red 4R, lithol red, pyrazolone red, watching red calcium salt, lake red D, brilliant carmine 6B, eosin lake, rhodamine lake B, alizarin lake, and brilliant carmine 3B; violet pigments, such as manganese violet, fast violet B, and methyl violet lake; blue pigments, such as iron blue, cobalt blue, alkali blue lake, Victoria blue lake, phthalocyanine blue, metal-free phthalocyanine blue, partially chlorinated phthalocyanine blue, fast sky blue, and indanthrene blue BC; green pigments, such as chrome green, chromium oxide, pigment green B, malachite green lake, and final yellow green G; and white pigments, such as zinc white, titanium oxide, antimony white, zinc sulfide, barite powder, barium carbonate, clay, silica, white carbon, talc, and alumina white, any other colorants known or yet to be discovered in the art or combinations thereof. In an embodiment, the content of the colorant may be in a range from about 1.0 to about 20.0 parts by mass, relative to 100 parts by mass of the binder resin. An embodiment may include colorant present in range from about 3.0 to about 10.0 parts by mass, relative to 100 parts by mass of the binder resin.

Some embodiments may include a charge control agent and wax incorporated into the toner base particles.

An embodiment may include a charge control agent. The charge control agent may control a triboelectric charging property of the toner. A charge control agent may be selected according to the desired charge polarity of the toner. Thus, some embodiments may use a positive charge control agent for positive charge control, a negative charge control agent for negative charge control, or a combination of a positive charge control agent and a negative charge control agent. In some embodiments, any charge control agent in the art may be used. For example, a charge control agent may include, but is not limited to nigrosine, a quaternary ammonium salt compound, a resin-type charge control agent in which an amine compound is combined with a resin, any charge control agents known in the art or combinations thereof. When the toner is a color toner, a colorless or white charge control agent may be used. Charge control agent in a range from about 0.1 to about 10.0 parts by mass, relative to 100 parts by mass of the binder resin. Some embodiments may include charge control agent in a range from about 0.5 to about 5.0 parts by mass, relative to 100 parts by mass of the binder resin.

Wax used in the toner may include, but is not limited to vegetable wax, such as carnauba wax, sugar wax, and tree wax; animal wax, such as beeswax, insect wax, whale wax, and wool wax; and synthetic hydrocarbon wax, such as Fischer-Tropsch wax (hereinafter referred to as "FT wax") having an ester on the side chain, polyethylene waxes, and polypropylene waxes. Some embodiments may include an FT wax having an ester on the side chain or a polyethylene wax. Waxes for use in a toner may be chosen based on dispersibility in an embodiment. The content of wax in the toner may be in a range from about 0.5 to about 15.0 parts by mass, relative to 100 parts by mass of the binder resin. Further, waxes may be present in the toner in a range from about 1.0 to about 10.0 parts by mass, relative to 100 parts by mass of the binder resin.

The toner base particles may be produced by a method including, but not limited to a kneading and pulverization method, a polymerization method, a spinning method, any method known in the art, or combinations thereof. In some embodiments, when producing toner base particles using the kneading and pulverization method, the necessary raw materials may be mixed together and pulverized. For example, necessary raw materials, such as binder resin, colorant, charge control agent, and wax, may be mixed with a mixer. In some embodiments, the mixer may be a Henschel mixer. In an embodiment, melt-mixing may be conducted with a twin screw extruder or the like. Pulverization may be conducted with a pulverizer including, but not limited to a pneumatic pulverizer, a jet air pulverizer; a mechanical pulverizer, a mill, a hammer mill, a jet pulverizer mill, a microjet mill, a ball mill, a tube mill, a ring and ball mill, a single mill, a twin mill, or any pulverizer currently known or yet to be discovered in the art. Classification of the base particles may allow different color components to be produced. In some embodiments, classification may be conducted with a classifier including, but not limited to a particle sizing and/or counting analyzer, such as an air classifier or a pneumatic classifier.

The produced toner base particles have a volume average particle diameter in a range from about 3.0 to about 10.0 μm.

Regarding the volume average particle diameter of the toner base particles, the particle size distribution of the base particles is measured by using a particle size distribution measuring equipment including, but not limited to particle sizing and/or counting analyzers, such as a Multisizer™ 3" Coulter Counter® produced by Beckman Coulter, Inc. In some embodiments, the particle size distribution may be measured using an aperture diameter of about 100 μm. Alternately, other aperture diameters may be used. The average particle diameter is expressed by the value calculated from the obtained measurement value.

In an embodiment, resin fine particles may be added to the toner base particles. Maintaining a specific exposed surface area on the toner particles may help to maintain the chargeability of the resin fine particles in some embodiments. Thus, even after the toner is used for a long period of time, the charge amount of the toner can be maintained. In such embodiments, a high-quality image can be stably formed. In an embodiment, using the toner for a long period of time may include stirring the toner for a long period of time in a developing device or the like. Fine particles may include, but are not limited to particles having a particle diameter smaller than that of the toner base particles.

In some embodiments, resin fine particles may include a polymer, for example a polymer having an isobornyl group-containing acrylate monomer. Another embodiment may include a polymer having a unit derived from an isobornyl group-containing acrylate monomer (e.g., isobornyl acrylate) represented by formula (1) below. Externally adding the resin fine particles with a polymer to the toner base particles may allow the charge amount of the toner base particles to be stably maintained. Utilizing the isobornyl group-containing acrylate monomer may improve the mechanical strength and high-temperature resistance of the resin fine particles. Thus, in some embodiments, utilizing the isobornyl group-containing acrylate monomer in the resin fine particles may reduce melting of the resin fine particles. In such embodiments, the resin fine particles are not easily melted. Thus, resin fine particles utilizing the isobornyl group-containing acrylate monomer adhere to the photosensitive member less than conventional resin fine particles, such as fluorine-containing resin fine particles and styrene acrylic resin fine particles.

(1)

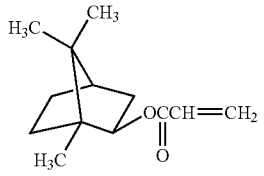

In some embodiments, the polymer may be a homopolymer obtained by polymerizing only isobornyl acrylate. In alternate embodiments, the polymer may include a copolymer obtained by copolymerizing isobornyl acrylate with another monomer copolymerizable with isobornyl acrylate. Further, some embodiments may utilize the homopolymer and the copolymer in combination as the resin fine polymer. In some embodiments, monomers utilized may include, but are not limited to styrene monomer and (meth)acrylate monomers (excluding isobornyl group-containing monomers).

An embodiment of the resin fine particles may include, but is not limited to a copolymer having an isobornyl group-containing acrylate monomer and styrene monomer (isobornyl group-containing styrene acrylic copolymer). In an embodiment, isobornyl acrylate may be copolymerized with styrene monomer to stabilize the chargeability of the resin fine particles.

An embodiment of resin fine particles may include other resin fine particles than the polymer having the isobornyl group-containing acrylate monomer described above. Examples of the other resin fine particles may include, but are not limited to acrylic polymers and/or copolymers of one or more acrylate monomers, one or more methacrylate monomers or combinations thereof.

Resin fine particles may be added to the toner base particles in an amount in a range from about 0.01 to about 5.00 parts by mass, relative to 100 parts by mass of the toner base particles. Further, some embodiments may include resin fine particles in an amount in a range from about 0.05 to about 2.00 parts by mass, relative to 100 parts by mass of the toner base particles. In an embodiment, the charge amount of the toner can be satisfactorily maintained when resin fine particles are added in amount of 0.01 parts by mass or more. In these embodiments, scattering of the toner may be suppressed, and fogging may be reduced. Limiting an amount of resin fine particles added to about 5.00 parts by mass or less, relative to 100 parts by mass of the toner base particles, it may be possible to reduce the amount of remaining resin fine particles that have not been melted. Thus, the incidence of insufficient fixing of the image onto the recording medium may be reduced. When resin fine particles other than isobornyl group-containing acyrlate monomer are used, an amount of other resin fine particles may be in a range from about one half to about one quarter of the amount of the polymer having the isobornyl group-containing acrylate monomer added. The amount of resin fine particles added may be calculated by measuring the number and area of resin fine particles using an SEM photograph of the surface of the toner.

The glass transition temperature (Tg) of the resin fine particles may be in a range from about 130° C. to about 200° C. In some embodiments, Tg may be in a range from about 150° C. to about 170° C. In an embodiment where the Tg is about 130° C. or higher, sufficient mechanical strength may be maintained. In such embodiments, the resin fine particles are not easily melted. Thus, even in a high-temperature environment and adhering of the resin fine particles to the photosensitive member may be suppressed. In addition, if Tg less than about 200° C. the resin fine particles are melted satisfactorily at a predetermined temperature when the image is fixed onto the recording medium. Thus, the toner image will be fixed onto the paper. In such embodiments, insufficient fixing of the toner image onto the paper may be reduced.

In some embodiments, the Tg of the resin fine particles may be measured by the method described below. Using a commercially available differential scanning calorimeter (DSC), the temperature of the resin fine particles may be increased at a rate of 10° C. per minute to a temperature higher than the Tg, and then may be decreased. Next, the temperature may be increased again to a temperature higher than the Tg, and the temperature may be maintained for 10 minutes in order to stabilize the temperature. The endothermic peak temperature of the resin fine particles during this series of operations is determined and defined as the Tg of the resin fine particles.

In some embodiments, additives, such as hydrophobic silica may be used in combination with the resin fine particles. By using hydrophobic silica together with the resin fine particles, flowability of the toner may be enhanced. Further, a uniformity of toner charging may be improved. An amount of hydrophobic silica added may be in a range from about 0.1 to about 5.0 parts by mass, relative to 100 parts by mass of the toner base particles. Some embodiments may include adding hydrophobic silica in an amount in a range from about 0.5 to about 2.0 parts by mass, relative to 100 parts by mass of the toner base particles.

In an embodiment, secondary additives other than the resin fine particles and the hydrophobic silica described above may be also used. Secondary additives may be used in a range that does not impair the function of the toner. Examples of secondary additives may include, but are not limited to alumina, magnetite, tin oxide, titanium oxide, strontium oxide, other additives known in the art and/or combinations thereof. In an embodiment, titanium oxide may be used. The amount of secondary additives used may be in a range from about 0.1 to about 5.0 parts by mass, relative to 100 parts by mass of the toner base particles. Further embodiments may include using secondary additives in an amount in a range from about 0.5 to about 2.0 parts by mass, relative to 100 parts by mass of the toner base particles.

A toner can be obtained by adding the external additives to at least a portion of the external surface of the toner base particles corresponding to each color of toner, followed by mixing with a mixer, such as a Henschel mixer. In some embodiments, the toner may be directly used as a single-component developer. Alternately, the toner may be combined with a carrier and used as a two-component developer. When the toner is combined with a carrier, the amount of toner added may be in a range from about 3.0 to about 20.0 parts by mass, relative to 100 parts by mass of the carrier. In an embodiment, when used in combination with a carrier toner may be added in a range from about 5.0 to about 15.0 parts by mass, relative to 100 parts by mass of the carrier.

Carriers may include, but are not limited to particles of a magnetic material, resin particles in which a magnetic material is dispersed in a binder resin, carriers known in the art and/or combinations thereof. Examples of the magnetic material may include, but are not limited to magnetic metals, such as iron, nickel, and cobalt, and alloys thereof; alloys containing rare-earth elements; and iron-based oxides, such as soft ferrite, e.g., hematite, magnetite, manganese-zinc ferrite, nickel-zinc ferrite, manganese-magnesium ferrite, lithium ferrite, and copper-zinc ferrite, mixtures thereof. Examples of the binder resin include vinyl resins, polyester resins, epoxy resins, phenolic resins, urea resins, polyurethane resins, polyimide resins, cellulosic resins, polyether resins, and mixtures thereof. Magnetic material particles may be produced by a process known in the art, such as a sintering process or an atomizing process. In an embodiment, the carrier may have a covering layer which includes a coating resin on the surface thereof.

When using an isoborynl group-containing acrylate monomer as an additive in a toner, it may be possible to improve the mechanical strength and heat resistance of the resin fine particles. As a result, melting of the resin fine particles may be reduced at the temperatures used in the development process. Thus, adhesion to the photosensitive member may be inhibited. Further, the charge amount of the toner may be maintained satisfactorily, and adhesion of the resin fine particles to the photosensitive member may be suppressed in a high temperature, high humidity environment. Thus, a high-quality image can be formed.

In certain instances, toner may be subjected to harsh conditions, such as high temperatures, and/or high humidity environments. After printing continuously in such harsh environments at a low coverage rate of about 0.2%, when printing is further performed at an increased coverage rate, the toner is significantly degraded and the charge amount of the toner tends to be decreased. When a toner is consumed by use of the developer for a long period of time, the toner may be replaced by supplying a new toner to the developing unit. In these instances, a difference may occur in the charge amount between the degraded toner and the new toner in the developing unit. In some embodiments, the degraded toner which has a depleted charge may scatter from the developing unit. As a result, image defects, such as fogging occur.

When using the toner for electrostatic development using resin fine particles as an external additive, the charge of the toner can be maintained. Consequently, even under the harsh conditions described above, it may be possible to reduce a decrease in the charge of the toner. Therefore, when a new toner is supplied, toner scattering may be suppressed because of the small difference between the charge of the new toner and the charge of the old toner (i.e., toner being replaced).

The toner for electrostatic development may be used as a developer in a general electrophotographic image forming apparatus, such as a printer, a copying machine, a facsimile machine, or a multifunctional apparatus having printing, copying, and facsimile functions. Using the toner may enable one to produce high-quality images.

An image forming apparatus uses the toner for electrostatic development. An example of the image forming apparatus will be described in detail below with reference to the drawing.

FIG. 1 is a schematic diagram showing an important portion of a tandem full-color image forming apparatus (hereinafter, simply referred to as "image forming apparatus") 10. The image forming apparatus 10 includes image forming units 11 respectively corresponding to yellow (Y), magenta (M), cyan (C), and black (BK).

In an embodiment, each of the image forming units 11 includes a photosensitive member 12 on which a toner image may be formed and which serves as a image support, a charging member 13, an exposing member 14, and a developing device 15. The developing device 15 may include the toner for electrostatic development. As the photosensitive member 12, for example, an amorphous silicon photosensitive member or an organic photosensitive member may be used. In each of the image forming units 11, the photosensitive member 12 is charged uniformly at a predetermined potential by the charging member 13. The surface of the charged photosensitive member 12 may be exposed by the exposing member 14 according to an image data, thereby to form an electrostatic latent image. By causing the toner from the developing device 15 to electrostatically adhere to the electrostatic latent image, a toner image is formed on the photosensitive member 12.

Furthermore, the image forming apparatus 10 may include an intermediate transfer member 16 to which the toner image formed on the photosensitive member 12 is transferred. The toner image formed on the photosensitive member 12 may be transferred using a primary transfer to a surface of the intermediate transfer member 16, i.e., a transfer surface 16*a*, by means of a primary transfer roller 17 which may be disposed opposite the corresponding image forming unit 11. The full color toner image transferred to the transfer surface 16*a* of the intermediate transfer member 16 may secondarily-transferred to a recording medium 19, such as paper, by means of a secondary transfer roller 18. The recording medium to which the toner image has been secondarily-transferred may be conveyed to a fixing device 24, where the toner image may be fixed on the recording medium by the action of heat and pressure. In an embodiment, the recording medium on which the toner image has been fixed is discharged to a catch tray (not shown) disposed outside the image forming apparatus. Note that the primary transfer rollers 17 and the secondary transfer roller 18 constitute a transfer unit.

In FIG. 1, reference numeral 20 represents a drive roller of the intermediate transfer member 16, reference numeral 21 represents a backup roller of the secondary transfer roller 18, reference numeral 22 represents a tension roller of the intermediate transfer member 16, and reference numeral 23 represents a cleaning blade for the intermediate transfer member 16.

In an embodiment of the image forming apparatus, the charge amount may be satisfactorily maintained due to the use of resin fine particles added to an external surface of the toner base particles. Further, in the high temperature, high humidity environments adhesion of resin fine particles to the photosensitive member may be suppressed allowing a high-quality image to be formed. Even under such harsh conditions, it is possible to reduce a decrease in the charge amount of the toner. Therefore, when a new toner is supplied, scattering of the toner from the developing unit may be suppressed because of the small difference in the charge amount between the new toner and the degraded toner.

An image forming apparatus may include, but is not limited to a tandem color developing system, a rotary color developing system, a monochrome image forming apparatus including only an image forming unit containing a black toner, or any image forming apparatus known in the art. Thus, the image forming apparatus used in combination with the toner for electrostatic development is not limited to the apparatus using the tandem color developing system described above.

An image forming method of the present invention uses the toner for electrostatic development. An example of the image forming method will be described below using the image forming apparatus 10 described above. First, in each of the image forming units 11, the surface of the photosensitive member 12 serving as a image support is charged by the charging member 13 (charging step). Next, the surface of the photosensitive member 12 is exposed by the exposing member 14 according to an image data, thereby to form an electrostatic latent image (i.e., an exposure step). Next, by causing the toner from the developing device 15 to electrostatically adhere to the electrostatic latent image, the electrostatic latent image may be developed as a toner image (i.e., development step). Next, the toner images on the photosensitive members 12 in the image forming units 11 are sequentially transferred to the surface (transfer surface 16*a*) of the intermediate transfer member 16 (i.e., primary transfer step). Next, the toner image on the intermediate transfer member 16 is transferred to the recording medium 19, such as paper, by means of the secondary transfer roller 18 (i.e., secondary transfer step). Then, the recording medium 19 is conveyed to the fixing device 24, where the toner image is fixed on the recording medium 19, and the recording medium 19 may be discharged to a catch tray or the like (not shown). Note that, the primary transfer step and the secondary transfer step constitute a transfer step. In the meantime, the toner remaining on the intermediate transfer member 16 may be scraped off by the cleaning blade 23.

Using this image forming method may allow the chargeability of the toner to be maintained satisfactorily due to the use of the resin fine particles added to an external surface of the toner base particles. Further, use of the resin fine particles described herein in a high temperature, high humidity environment, may reduce and/or inhibit adhesion of resin fine particles to the photosensitive member allowing a high-quality image to be formed.

EXAMPLES

Hereinafter, an embodiment will be described specifically on the basis of examples. However, it is to be understood that the present invention is not limited to the examples. The "parts" and "%" in the description below represent "parts by mass" and "% by mass", respectively.

Production of Resin Fine Particles

Resin Fine Particles A

In a 2-L separable flask equipped with a stirrer, a thermometer, a nitrogen introduction tube, a reflux condenser, and a dropping funnel, 1 part of diethanolamide laurate was mixed into 100 parts of ion-exchanged water, and the mixture was heated to 80° C. in a nitrogen gas atmosphere. Then, 0.1 parts of 2,2'-azobis(2-methylpropionamidine)dihydrochloride was added to the ion-exchanged water mixed with diethanolamide laurate, and 40 parts of styrene, 30 parts of isobornyl acrylate, and 30 parts of n-butyl methacrylate were added dropwise thereto. Then, polymerization was carried out for 3 hours with the temperature being maintained at 80° C. The resulting liquid was purified with an ultrafilter, and then dried by spray drying. Thereby, resin fine particles A having a glass transition temperature (Tg) of 150° C. were obtained. The presence or absence of a polymer having an isobornyl group-containing acrylate monomer in the resin fine particles was identified by infrared spectroscopic analysis of the toner. Furthermore, the Tg was measured by the method described below.

Measurement of Glass Transition Temperature

Using a differential scanning calorimeter ("Q100" manufactured by TA Instrument), the temperature of the resin fine particles was increased at a rate of 10° C. per minute to a temperature higher than the Tg. Then, the temperature of the resin fine particles was decreased, and was increased again to a temperature higher than the Tg. The temperature was maintained for 10 minutes in order to stabilize the temperature. The endothermic peak value of the resin fine particles during the series of operations was calculated and defined as the Tg of the resin fine particles.

Resin Fine Particles B

Resin fine particles B were produced as in the resin fine particles A except that the amount of added isobornyl acrylate was changed to 15 parts by mass and the amount of added n-butyl methacrylate was changed to 45 parts by mass. The Tg of the resin fine particles B was 130° C.

Resin Fine Particles C

Resin fine particles C were produced as in the resin fine particles A except that the amount of added isobornyl acrylate was changed to 45 parts by mass and the amount of added n-butyl methacrylate was changed to 15 parts by mass. The Tg of the resin fine particles C was 200° C.

Resin Fine Particles D

Resin fine particles D were produced as in the resin fine particles A except that the amount of added isobornyl acrylate was changed to 5 parts by mass and the amount of added n-butyl methacrylate was changed to 55 parts by mass. The Tg of the resin fine particles D was 120° C.

Resin Fine Particles E

Resin fine particles E were produced as in the resin fine particles A except that the amount of added isobornyl acrylate was changed to 55 parts by mass and the amount of added n-butyl methacrylate was changed to 5 parts by mass. The Tg of the resin fine particles E was 220° C.

Resin Fine Particles F

In a 2-L separable flask equipped with a stirrer, a thermometer, a nitrogen introduction tube, a reflux condenser, and a dropping funnel, 3 parts of sodium lauryl sulfate was mixed into 200 parts of ion-exchanged water, and the mixture was heated to 80° C. in a nitrogen gas atmosphere. Then, 1 part of ammonium persulfate was added thereto while stirring. A monomer mixture including 70 parts of methyl methacrylate and 30 parts of n-butyl acrylate was further added thereto dropwise over 1 hour, followed by stirring for 1 hour, to give an emulsion. The resulting emulsion was dried, and thereby, resin fine particles F having an average primary particle diameter of 74 nm were obtained. The Tg of the resin fine particles F was 120° C. Note that, the average primary particle diameter of the resin fine particles F is the value measured by the same method as the method for measuring the average particle diameter of toner base particles, which will be described later.

Resin Fine Particles G

Resin fine particles G having an average primary particle diameter of 77 nm were obtained as in the resin fine particles F except that, after the mixture was heated to 75° C. instead of 80° C., 1 part of ammonium persulfate was added, and a monomer mixture including 70 parts of methyl methacrylate and 30 parts of n-butyl acrylate was further added thereto dropwise over 5 hours. The Tg of the resin fine particles G was 130° C.

Resin Fine Particles H

Resin fine particles H were produced as in the resin fine particles A except that the amount of added isobornyl acrylate was changed to 0 parts by mass and the amount of added n-butyl methacrylate was changed to 60 parts by mass. The Tg of the resin fine particles H was 105° C.

Example 1

Production of Toner for Electrostatic Development

To 100 parts of a polyester resin obtained by condensation of a bisphenol and fumaric acid (ALMATEX P645 manufactured by Mitsui Chemicals, Inc.) as a binder resin, 4 parts of a copper phthalocyanine pigment (Pigment Blue 15-3; Heliogen Blue D7079 manufactured by BASF) as a colorant, 2 parts of a quaternary ammonium salt compound ("BONTRON P-51" manufactured by Orient Chemical Industries, Ltd.) as a charge control agent, and 3 parts of a Fischer-Tropsch wax ("FT-100" manufactured by Nippon Seiro Co., Ltd.) as a wax were added. The resulting mixture was placed in a Henschel mixer (manufactured by Mitsui Mining Co., Ltd.) and mixing was performed for 2 minutes. Then, melt-kneading was performed with a twin-screw extruder, and thereby, a toner mixture was prepared. The resulting toner mixture was pulverized with an air crusher, and classification was performed with a wind classifier. Thereby, toner base particles having a volume-average particle diameter of 8 μm were obtained. In order to measure the volume-average particle diameter of the toner base particles, using a particle size distribution measuring device ("Multisizer 3" manufactured by Beckman Coulter, Inc.), the particle size distribution was measured at an aperture diameter of 100 μm. The volume-average particle diameter was calculated from the measured particle size distribution.

To 100 parts of the resulting toner base particles, 0.4 parts of the resin fine particles A, 1.0 part of hydrophobic silica ("TG-820" manufactured by Cabot Corporation), and 1.0 part of titanium oxide ("TTO-55A" manufactured by Ishihara Sangyo Kaisha Ltd.) were added as external additives. The resulting mixture was placed in a Henschel mixer, and mixing was performed at 3,000 rpm for 10 minutes. Thereby, a toner for electrostatic development was obtained. Then, the resulting toner for electrostatic development and a ferrite carrier ("EF-60B" manufactured by Powdertech Co., Ltd.; average particle diameter: 60 μm) were mixed so that the toner concentration was 8%, and uniform stirring and mixing were performed. Thereby, a two-component developer was obtained.

Evaluation

Evaluation 1: At Coverage Rate of 0.2%

A color multifunctional system "KM-3232" manufactured by Kyocera Mita Corporation (equipped with an amorphous silicon photosensitive member) was modified and used as an evaluation machine. The obtained two-component developer was set in the evaluation machine, and after the evaluation machine was turned on and stabilized in a high temperature, high humidity environment (temperature: 32.5° C., relative humidity: 80% RH), an image at a coverage rate of 0.2% was continuously printed on 10,000 sheets. Then, a sample image was printed. The sample image included a solid region and a white background region. The image density (ID) was measured with a Macbeth reflection density meter ("RD-191" manufactured by Gretag Macbeth) with respect to three portions in the solid region of the sample image. Then, the average value of the three portions was calculated. The ID of 1.20 or more was evaluated as passed. The results are shown in Table 2.

Furthermore, the white background region of the sample image was measured with a Macbeth reflection density meter, and the measured value was defined as the fog density (FD). The FD of 0.010 or less was evaluated as passed. The results are shown in Table 2.

Furthermore, the presence or absence of adhesion of resin fine particles on the photosensitive member after continuous printing was visually confirmed. The results are shown in Table 2.

Furthermore, with respect to 10,000 sheets after continuous printing, the presence or absence of defects, such as toner scattering, generation of black spots, and insufficient fixing of image, was visually confirmed. The results are shown in Table 2. The image was fixed under a condition of 150° C.

Evaluation 2: At Coverage Rate of 5.0%

After Evaluation 1, in a high temperature, high humidity environment (temperature: 32.5° C., relative humidity: 80% RH), an image at a coverage rate of 5.0% was further continuously printed on sheets. Then, a sample image was printed. Next, as in Evaluation 1, the image density (ID) and the fog density (FD) of the sample image were measured, and the presence or absence of adhesion of resin fine particles on the surface of the photosensitive member after continuous printing and the presence or absence of defects on the 10,000 sheets continuously printed were visually confirmed. The results are shown in Table 2.

Comprehensive Evaluation

In Evaluations 1 and 2, the case where the fog density (FD) was 0.010 or less and no defects were present is evaluated as "○", the case where the FD was 0.010 or less, but any of the defects was present was evaluated as "Δ", and the case where the FD exceeded 0.010 was evaluated as "x". The results are shown in Table 2.

Examples 2 to 9

Two-component developers were produced as in Example 1 except that the type and the amount resin fine particles added was changed as shown in Table 1, and the evaluations were carried out. The results are shown in Table 2.

Comparative Examples 1 to 3

Two-component developers were produced as in Example 1 except that the type and the amount resin fine particles added was changed as shown in Table 1, and the evaluations were carried out. The results are shown in Table 2.

Comparative Example 4

A two-component developer was produced as in Example 1 except that no resin fine particles were used, and the evaluations were carried out. The results are shown in Table 2.

TABLE 1

| | Resin fine particles | | | |
|---|---|---|---|---|
| | Type | Copolymer | Glass transition temperature (° C.) | Amount of addition (parts by mass) |
| Example 1 | A | Isobornyl group-containing styrene acrylic copolymer | 150 | 0.4 |
| Example 2 | A | Isobornyl group-containing styrene acrylic copolymer | 150 | 0.05 |
| Example 3 | A | Isobornyl group-containing styrene acrylic copolymer | 150 | 2.0 |
| Example 4 | B | Isobornyl group-containing styrene acrylic copolymer | 130 | 0.4 |
| Example 5 | C | Isobornyl group-containing styrene acrylic copolymer | 200 | 0.4 |
| Example 6 | A | Isobornyl group-containing styrene acrylic copolymer | 150 | 0.04 |
| Example 7 | A | Isobornyl group-containing styrene acrylic copolymer | 150 | 2.1 |
| Example 8 | D | Isobornyl group-containing styrene acrylic copolymer | 120 | 0.4 |
| Example 9 | E | Isobornyl group-containing styrene acrylic copolymer | 220 | 0.4 |
| Comparative Example 1 | F | Acrylic copolymer | 120 | 0.4 |
| Comparative Example 2 | G | Acrylic copolymer | 130 | 0.4 |
| Comparative Example 3 | H | Styrene acrylic copolymer | 105 | 0.4 |
| Comparative Example 4 | — | — | — | — |

As is evident from Table 2, in each Example in which the isobornyl group-containing styrene acrylic copolymer was used as the resin fine particles, under the harsh conditions of high temperature and high humidity, good image density and good fog density were maintained. Furthermore, adhesion of the resin fine particles to the photosensitive member was suppressed. In particular, in Examples 1 to 5 in which the glass transition temperature of the resin fine particles was 130° C. to 200° C., and the amount of resin fine particles added was in range from 0.05 to 2.0 parts by mass, it was possible to suppress the defects, such as toner scattering and insufficient fixing, throughout the printing of 20,000 sheets.

In contrast, in Comparative Examples 1 and 2 in which the acrylic copolymer without an isobornyl group-containing acrylate monomer was used as the resin fine particles, the mechanical strength of the resin fine particles was low, and the resin fine particles were easily melted. Therefore, the resin fine particles adhered to the photosensitive member, and undesired black spots occurred on the paper image formed.

In comparative Example 3 in which the styrene acrylic copolymer without an isobornyl group-containing acrylate monomer was used as the resin fine particles, the mechanical strength of the resin fine particles was low, and the resin fine particles were easily melted. Therefore, the resin fine particles adhered to the photosensitive member, and undesired black spots occurred on the paper image formed.

In Comparative Example 4 in which no resin fine particles were used, the toner was degraded significantly under the harsh conditions of high temperature and high humidity, and the charge amount of the toner was easily decreased. Furthermore, by supplying a new toner during the process of printing of 20,000 sheets, a difference occurred in the charge amount between the degraded toner and the new toner, and the degraded toner scattered, resulting in an increase in the fog density.

TABLE 2

| | Evaluation 1 (coverage rate 0.2%) | | | | Evaluation 2 (coverage rate 5.0%) | | | | |
|---|---|---|---|---|---|---|---|---|---|
| | ID | FD | Adhesion of resin fine particles | Defects | ID | FD | Adhesion of resin fine particles | Defects | Comprehensive evaluation |
| Example 1 | 1.41 | 0.004 | None | None | 1.4 | 0.005 | None | None | ○ |
| Example 2 | 1.36 | 0.006 | None | None | 1.32 | 0.008 | None | None | ○ |
| Example 3 | 1.39 | 0.002 | None | None | 1.38 | 0.003 | None | None | ○ |
| Example 4 | 1.40 | 0.005 | None | None | 1.36 | 0.006 | None | None | ○ |
| Example 5 | 1.39 | 0.006 | None | None | 1.34 | 0.006 | None | None | ○ |
| Example 6 | 1.34 | 0.007 | None | None | 1.22 | 0.010 | None | Toner scattering | Δ |
| Example 7 | 1.39 | 0.001 | None | Insufficient fixing | 1.42 | 0.002 | None | Insufficient fixing | Δ |
| Example 8 | 1.39 | 0.004 | Slight adhesion | None | 1.29 | 0.007 | Slight adhesion | None | Δ |
| Example 9 | 1.38 | 0.005 | None | Insufficient fixing | 1.28 | 0.006 | None | Insufficient fixing | Δ |
| Comparative Example 1 | 1.38 | 0.006 | Adhesion | None | 1.31 | 0.016 | Adhesion | None | X |
| Comparative Example 2 | 1.39 | 0.005 | Slight adhesion | None | 1.33 | 0.017 | Adhesion | None | X |
| Comparative Example 3 | 1.34 | 0.008 | Adhesion | None | 1.21 | 0.016 | Adhesion | None | X |
| Comparative Example 4 | 1.39 | 0.009 | — | None | 1.36 | 0.030 | — | Toner scattering | X |

Having thus described in detail the embodiments of the present invention, it is to be understood that the invention defined by the foregoing paragraphs is not to be limited to particular details and/or embodiments set forth in the above description, as many apparent variations thereof are possible without departing from the spirit or scope of the present invention.

What is claimed is:

1. A toner for electrostatic development comprising:
toner base particles; and
two or more external additives comprising:
resin fine particles; and
hydrophobic silica;
wherein the resin fine particles comprise a polymer having an isobornyl group-containing acrylate monomer.

2. The toner for electrostatic development according to claim 1, wherein the polymer further comprises a styrene monomer unit.

3. The toner for electrostatic development according to claim 2, wherein the polymer further comprises a methacrylate monomer unit.

4. The toner for electrostatic development according to claim 1, wherein the glass transition temperature of the resin fine particles is in a range from about 130° C. to about 200° C.

5. The toner for electrostatic development according to claim 1, wherein the amount of the resin fine particles added to the toner base particles is in a range from about 0.01 to about 5.00 parts by mass relative to 100 parts by mass of the toner base particles.

6. The toner for electrostatic development according to claim 1, wherein the amount of the resin fine particles added to the toner base particles is in a range from about 0.05 to about 2.00 parts by mass relative to 100 parts by mass of the toner base particles.

7. An image forming apparatus comprising:
a latent image supporting member;
a charging unit which charges uniformly the latent image supporting member;
an exposing unit which exposes the latent image supporting member uniformly charged by the charging unit so that an electrostatic latent image is formed on the latent image supporting member;
a developing device which develops the electrostatic latent image formed by the exposing unit on the latent image supporting member with a toner so that a toner image is formed; and
a transfer unit which transfers the toner image to a recording medium,
wherein the toner comprises;
toner base particles;
resin fine particles comprising a polymer having an isobornyl group-containing acrylate monomer; and
hydrophobic silica.

8. The image forming apparatus according to claim 7, wherein the polymer further comprises a styrene monomer unit.

9. The image forming apparatus according to claim 8, wherein the polymer further comprises a methacrylate monomer unit.

10. The image forming apparatus according to claim 7, wherein the glass transition temperature of the resin fine particles is in a range from about 130° C. to about 200° C.

11. The image forming apparatus according to claim 7, wherein the amount of the resin fine particles added to the toner base particles is in a range from about 0.01 to about 5.00 parts by mass, relative to 100 parts by mass of the toner base particles.

12. The image forming apparatus according to claim 7, wherein the amount of the resin fine particles added to the toner base particles is in a range from about 0.05 to about 2.00 parts by mass relative to 100 parts by mass of the toner base particles.

13. An image forming method comprising:
charging a latent image supporting member uniformly by a charging member;
forming an electrostatic latent image by an exposing unit on the uniformly charged latent image supporting member;
developing the electrostatic latent image with a toner by a developing device to form a toner image; and
transferring the toner image by a transfer unit to a recording medium,
wherein the toner comprises:
toner base particles; and
external additives comprising:
resin fine particles comprising a polymer having an isobornyl group-containing acrylate monomer; and
hydrophobic silica.

14. The image forming method according to claim 13, wherein the polymer further comprises a styrene monomer unit.

15. The image forming method according to claim 14, wherein the polymer further comprises a methacrylate monomer unit.

16. The image forming method according to claim 13, wherein the glass transition temperature of the resin fine particles is in a range from about 130° C. to about 200° C.

17. The image forming method according to claim 13, wherein the amount of the resin fine particles added to the toner base particles is in a range from about 0.01 to about 5.00 parts by mass relative to 100 parts by mass of the toner base particles.

18. The image forming method according to claim 13, wherein the amount of the resin fine particles added to the toner base particles is in a range from about 0.05 to about 2.00 parts by mass relative to 100 parts by mass of the toner base particles.

* * * * *